US006671474B2

(12) United States Patent
Chadani

(10) Patent No.: US 6,671,474 B2
(45) Date of Patent: Dec. 30, 2003

(54) DEVELOPER CONTAINER, PROCESS CARTRIDGE, AND ELECTROPHOTOGRAPHIC IMAGE FORMING APPARATUS

(75) Inventor: Kazuo Chadani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/047,107

(22) Filed: Jan. 17, 2002

(65) Prior Publication Data

US 2002/0098007 A1 Jul. 25, 2002

(30) Foreign Application Priority Data

Jan. 19, 2001 (JP) ..... 2001-011313

(51) Int. Cl.[7] ..... G03G 15/04; G03G 15/08

(52) U.S. Cl. ..... 399/106; 399/119; 399/120; 222/DIG. 1

(58) Field of Search ..... 399/106, 111, 399/119, 120, 260, 262; 222/DIG. 1

(56) References Cited

U.S. PATENT DOCUMENTS 5,943,529 A 8/1999 Miyabe et al. ..... 399/111
5,966,567 A 10/1999 Matsuzaki et al. ..... 399/111
6,144,815 A 11/2000 Chadani et al. ..... 399/27
6,167,227 A * 12/2000 Fujita et al. ..... 399/258
6,173,140 B1 1/2001 Suzuki et al. ..... 399/113
6,173,145 B1 1/2001 Chadani et al. ..... 399/265
6,178,302 B1 1/2001 Nagashima et al. ..... 399/106
6,205,305 B1 3/2001 Suzuki et al. ..... 399/106
6,219,504 B1 4/2001 Matsuzaki et al. ..... 399/92
6,282,389 B1 8/2001 Matsuzaki et al. ..... 399/111
6,301,457 B1 10/2001 Chadani et al. ..... 399/167

* cited by examiner

*Primary Examiner*—Hoang Ngo
(74) *Attorney, Agent, or Firm*—Fitzpatrick, Cella, Harper & Scinto

(57) ABSTRACT

A developer container includes a container body for containing a developer. The container body is formed by a bottom wall, two side walls, a first end wall, and a second end wall, the first end wall being provided with an opening for feeding the developer. The container also includes a member connecting the first end wall and the second end wall to prevent deformation of an attachment surface for a toner seal member.

18 Claims, 9 Drawing Sheets

DEVELOPER CONTAINER, PROCESS CARTRIDGE, AND ELECTROPHOTOGRAPHIC IMAGE FORMING APPARATUS

BACKGROUND OF THE INVENTION

1. Field of the Invention

The invention relates to a developer container usable in an electrophotographic image forming apparatus, a process cartridge, and an electrophotographic image forming apparatus.

Here, the electrophotographic image forming apparatus forms an image on a recording medium by the use of the electophotographic image forming process. The examples of the electrophotographic image forming apparatus include, for example, an electrophotographic copier, an electrophotographic printer (such as a laser beam printer or an LED printer), a facsimile apparatus, and a word processor.

The aforementioned process cartridge may refer to charging means, developing means or cleaning means and an electrophotographic photosensitive member integrally made into a cartridge, which is made detachably mounted to the main body of the electrophotographic image forming apparatus. Alternatively, the process cartridge may refer to at least one of charging means, developing means, and cleaning means and an electrophotographic photosensitive member integrally made into a cartridge, which is made detachably mountable to the main body of the electrophotographic image forming apparatus. Further alternatively, the process cartridge may refer to at least developing means and an electrophotographic photosensitive member integrally made into a cartridge, which is made detachably mountable to the main body of the electrophotographic image forming apparatus.

2. Description of Related Art

In an electrophotographic image forming apparatus using the electrophotographic image forming process, there has heretofore been adopted a process cartridge system in which an electrophotographic photosensitive member and process means for acting on the electrophotographic photosensitive member are integrally made into a cartridge which is made detachably mountable to the main body of the image forming apparatus. According to the process cartridge system, the maintenance of the apparatus can be done by a user himself without resort to a serviceman and therefore, the operability of the apparatus be markedly improved. So, this process cartridge system is widely used in electrophotographic image forming apparatuses.

As shown in FIG. 12 of the accompanying drawings, a process cartridge 45 according to the prior art comprises a developing frame 43 supporting a developing member such as a developing roller 48 and a toner container 46 ultrasonically welded together to form a developing unit. A photosensitive drum 44, a charging roller 41 and a cleaning frame 47 constituting a removed toner container are connected together by a shaft 49. A compression coil spring 42 is provided between the cleaning frame 47 and the developing frame 43 to thereby bias the photosensitive drum 44 and the developing roller 48 toward each other.

There has been a trend toward increasing the capacity of the toner container of a process cartridge used by an electrophotographic image forming apparatus and toward increasing the size of the removed toner container to lengthen the service life of the process cartridge until interchanged.

However, when the capacity of the toner container is increased, the weight of a toner increases with a result that when the quantity of the developer is increased by the use of the prior art device, the load applied to the developing roller and the photosensitive drum increases. Also, as the developer is consumed the load is changed.

In order to solve this problem, a flexible sheet member is stuck on between the toner container and a developing container. A method of hermetically sealing the space between the two containers to thereby reduce the weight of a toner containing frame being applied to the developing container is under consideration.

SUMMARY OF THE INVENTION

It is an object of the present invention to provide a developer container, a process cartridge, and an electrophotographic image forming apparatus in which the strength of an opening portion can be enhanced.

It is another object of the present invention to provide a developer container, a process cartridge and an electrophotographic image forming apparatus in which the deformation of an opening portion can be prevented.

It is another object of the present invention to provide a developer container in which a developing frame is not welded and a developer supply opening portion is sealed by a toner seal member and the deformation of the stuck surface of the toner seal member does not occur, and a process cartridge having the developer container, and an electrophotographic image forming apparatus, to which the process cartridge is detachably mountable.

It is another object of the present invention to provide a developer container containing a developer therein and having an opening portion sealed by a toner seal member adapted to be unsealed during use to supply a developer to developing means, and provided with a bridge-shaped portion extending from the back side of the surface of the opening portion side for supplying the developer and connected to the other end surface opposed to the surface substantially parallel thereto.

It is another object of the present invention to provide a process cartridge detachably mountable to an image forming apparatus, the process cartridge comprising an electrophotographic photosensitive member, developing means for visualizing an electrostatic latent image formed on the electrophotographic photosensitive member, a developing frame supporting the developing means and having an opening portion for receiving a developer therein, a developer container displaceable relative to the developing frame and containing the developer therein and having an opening portion for supplying the developer to the developing means, and provided with a bridge-shaped portion extending from the back side of the surface of the opening portion side for supplying the developer and connected to the other end surface opposed to the surface substantially parallel thereto, and a toner seal member for unsealably sealing the opening portion.

It is another object of the present invention to provide an electrophotographic image forming apparatus, to which a process cartridge is detachably mountable for forming an image on a recording medium, the electrophotographic image forming apparatus comprising:

a) mounting means for detachably mounting a process cartridge comprising an electrophotographic photosensitive member, developing means for visualizing an electrostatic latent image formed on the electrophotographic photosensitive member by a portion for receiving the developer therein, a developer container displaceable relative to the developing frame and containing the developer therein and having an opening portion for supplying the developer to the developing means, and provided with a bridge-shaped portion extending from the back side of the surface of the opening portion side for supplying the developer and connected to the other end surface opposed to the surface substantially parallel thereto, and a toner seal member for unsealably sealing the opening portion; and These and other objects, features and advantages of the present invention will become more apparent upon consideration of the following description of the preferred embodiment of the present invention taken in conjunction with the accompanying drawings.

DESCRIPTION OF THE PREFERRED EMBODIMENT

An embodiment of the present invention will hereinafter be described with reference to FIGS. 1 to 11. The lengthwise direction in the embodiment refers to a direction perpendicular to the transporting direction of a recording medium and parallel to the surface of the recording medium.

(Description of a Process Cartridge and the Main Body of an Apparatus)

Figure 1:
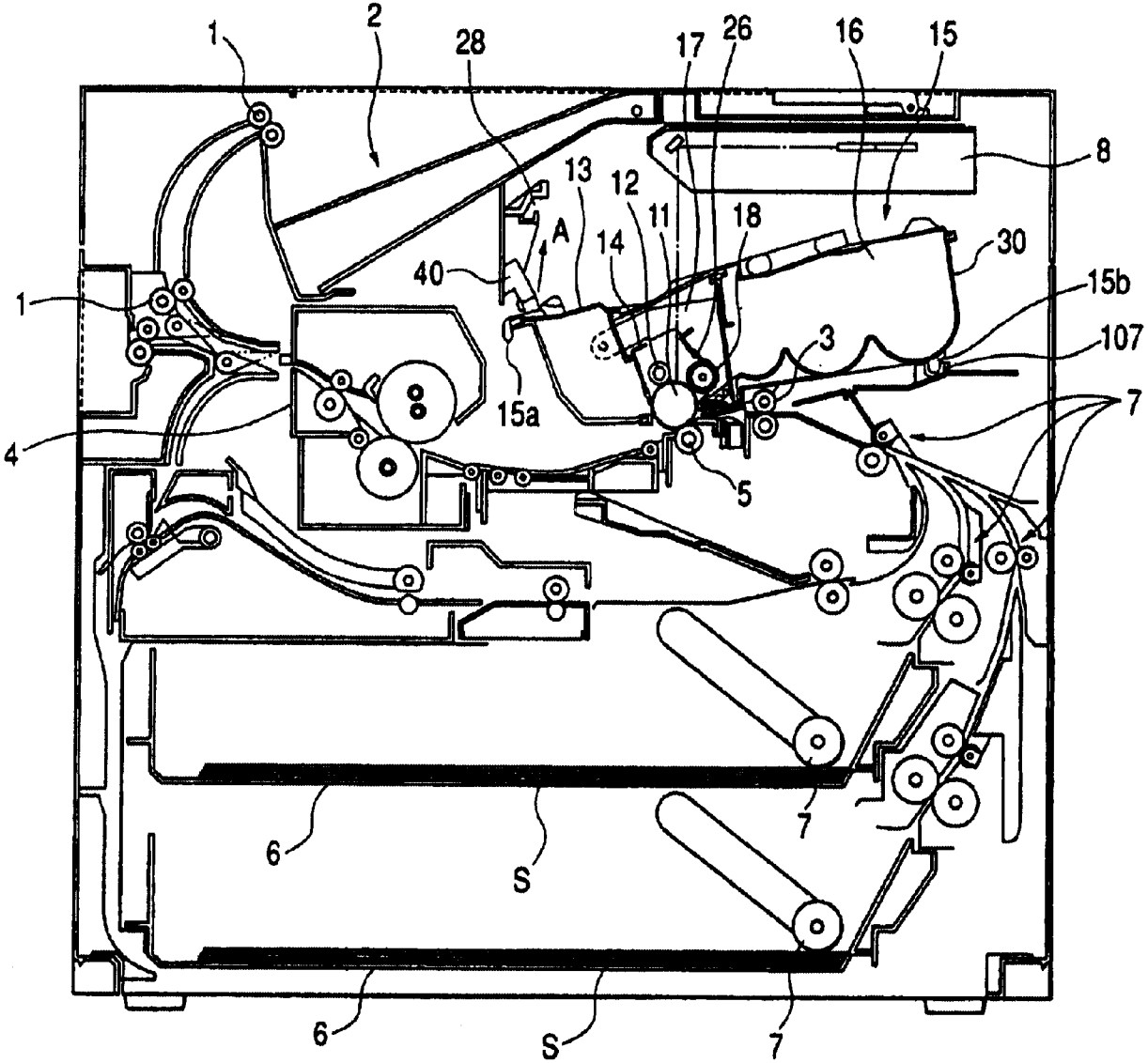
FIG. 1 is a vertical cross-sectional view of an image forming apparatus.
Figure 2:
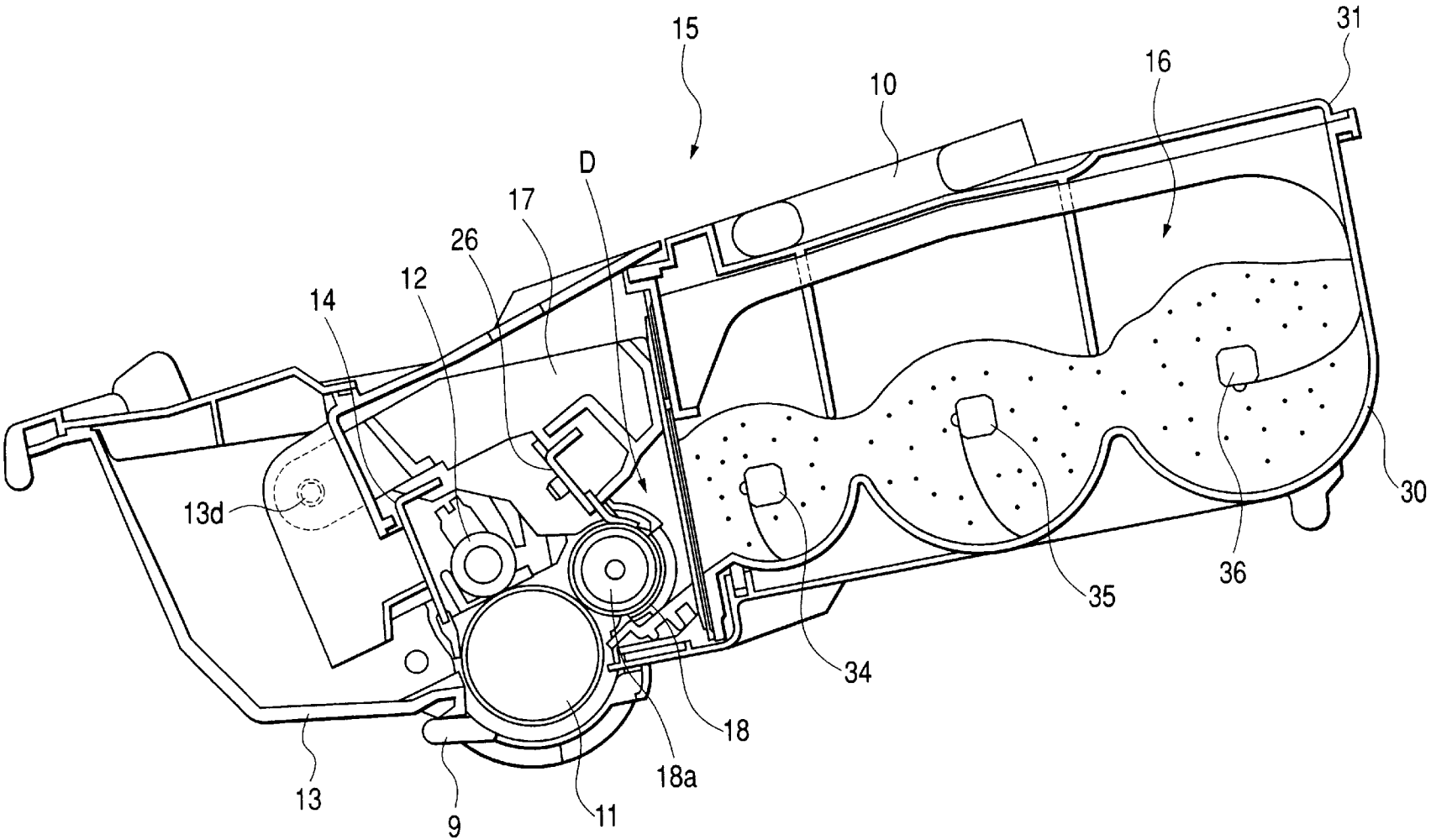
FIG. 2 is a main cross-sectional schematic view of a process cartridge in an embodiment of the present invention.

FIG. 1 is a main cross-sectional view of an image forming apparatus according to the present invention, and FIG. 2 is a main cross-sectional view of a process cartridge according to the present invention. The process cartridge is provided with an image bearing member and process means for acting on the image bearing member. The process means include, for example, charging means for charging the surface of the image bearing member, a developing device for forming a toner image on the image bearing member, and cleaning means for removing any toner residual on the surface of the image bearing member. The process cartridge can be provided with the image bearing member and at least one of the process means.

The process cartridge 15 in the present embodiment, as shown in FIG. 2, comprises an electrophotographic photosensitive drum (hereinafter referred to as the photosensitive drum) 11 which is an image bearing member, a charging roller 12 which is charging means arranged around the photosensitive drum 11, a cleaning frame 13 containing therein a cleaning blade 14 as cleaning means, a drum protecting shutter 9 for protecting the photosensitive drum 11, a developing frame 17 containing therein a developing roller 18 and a developing blade 26 as a developing device, and a toner containing unit 16 for containing therein a toner which is a developer. The toner containing unit 16 is constituted by a toner container 30 and a toner containing lid 31. The toner container 30 contains agitating members 34, 35 and 36 as rotary members for agitating the toner. The toner container 30 and the toner containing lid 31 are welded together to form the toner containing unit 16. And these are integrally made into the process cartridge 15 which is made detachably mountable to the main body of the image forming apparatus without any unreasonable force being applied to the process means by holding a handle 10 provided on the upper portion of the toner containing lid 31.

The process cartridge 15 is mounted to the image forming apparatus as shown in FIG. 1 and is used for image formation. Image formation is effected on a sheet S as a recording medium transported from sheet cassettes 6 mounted on the lower portion of the apparatus to the transferring position of the photosensitive drum 11 by transporting rollers 7.

The photosensitive drum 11 is charged by the charging roller 12, whereafter it is subjected to selective exposure in conformity with image information by an exposing device 8, whereby an electrostatic latent image is formed thereon. The exposure is effected in synchronism with the transportation of the sheet by registration rollers 3.

Thereafter, the toner contained in the toner containing unit 16 is fed to the developing frame 17 side, and the toner is applied as a thin layer onto the surface of the developing roller 18 by the developing blade 26, and a developing bias voltage is applied to the developing roller 18, whereby the toner is supplied from the developing roller 18 to the photosensitive drum 11 in conformity with the latent image. A toner image thus formed on the photosensitive drum 11 is transferred to the sheet S being transported by the application of a bias voltage to a transferring roller 5 at a transferring position, and the sheet S is transported to a fixing device 4, whereby the toner image is fixed, and the sheet S is delivered to a delivery portion 2 in the upper portion of the apparatus by delivery rollers 1. On the other hand, any toner residual on the photosensitive drum 11 after the transfer of the toner image is removed by the cleaning blade 14 and is stored in the cleaning frame 13.

(Frame Construction of the Process Cartridge)

The surrounding portions of the developing device will be further described in detail.

Figure 3:
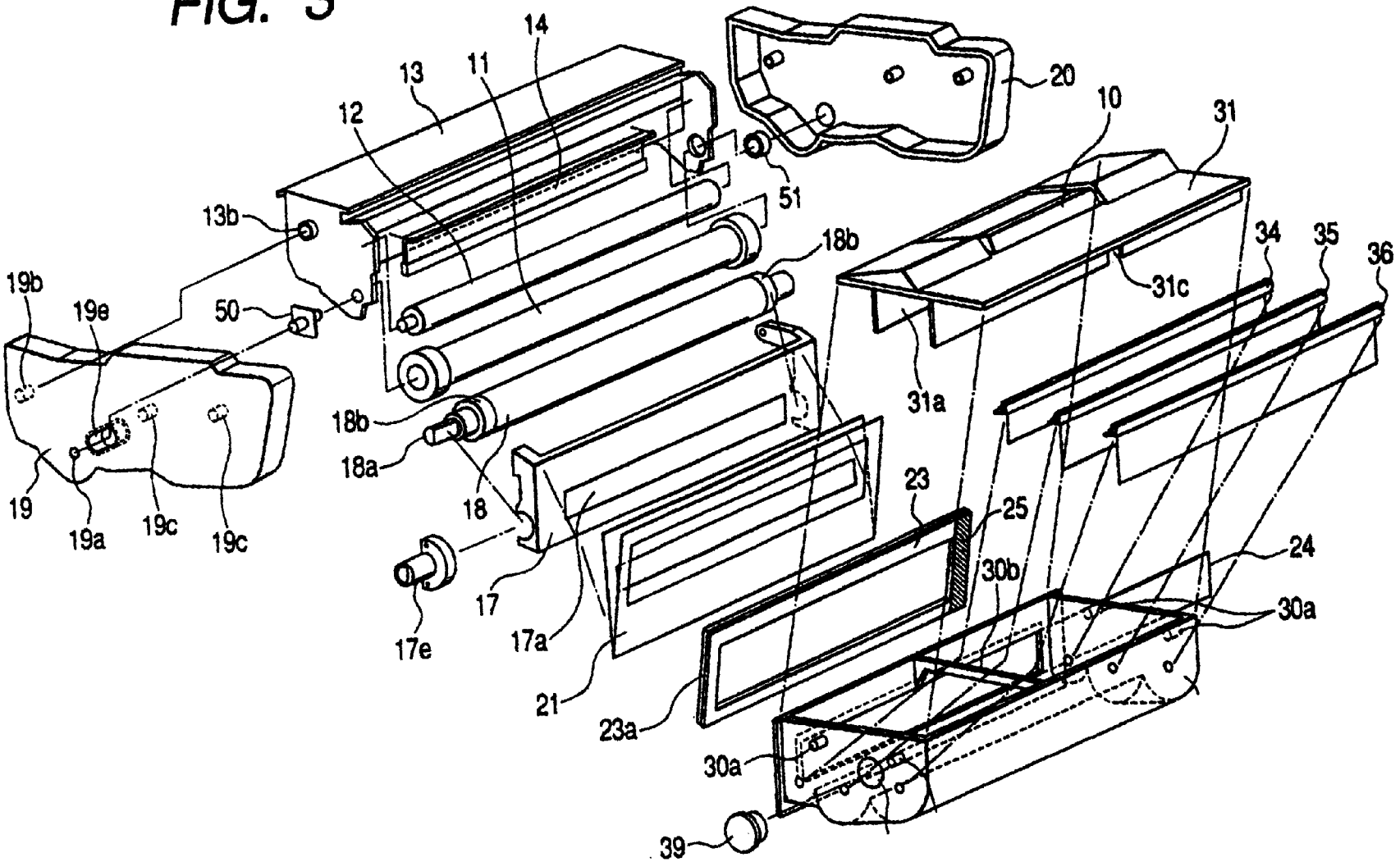
FIG. 3 is an exploded perspective view of the process cartridge in the embodiment of the present invention.

FIGS. 2 and 3 schematically show the construction of the process cartridge 15 in the present embodiment. The developing device D in the process cartridge 15 is such that the toner contained in the toner containing unit 16 is borne on the surface of the developing roller 18 as a toner bearing member and also, a developing bias voltage is applied to the developing roller 18 to thereby supply the toner in conformity with the latent image formed on the photosensitive drum 11.

The developing roller 18 is comprised of a cylindrical metal such as aluminum or stainless steel and contains a magnet roller 18*a* therein.

FIG. 3 is a typical exploded view showing the construction of the process cartridge. The toner containing unit 16 is positioned by the bosses 19*c* of side cover 19 and bosses of side cover 20 being fitted onto the positioning pins 30*a* of the toner container 30, and is fixed to the side covers 19 and 20 in position. Also, the cleaning frame 13 rotatably supports the photosensitive drum 11 through a bearing pin 50 and a bearing 51. The cleaning frame 13, similarly to the toner containing unit 16, is fixed to the side cover 19 by a positioning boss 13*b* being fitted onto a positioning pin 19*b* and by the bearing pin 50 fixed to the cleaning frame 13 being fitted into a hole 19*a* in the side cover 19. The positioning of the side cover 20 and the cleaning frame 13 is similar to that on the side cover 19 side. Thus, the cleaning frame 13 and the toner containing unit 16 are integrally fixed through the side covers 19 and 20.

Figure 6:
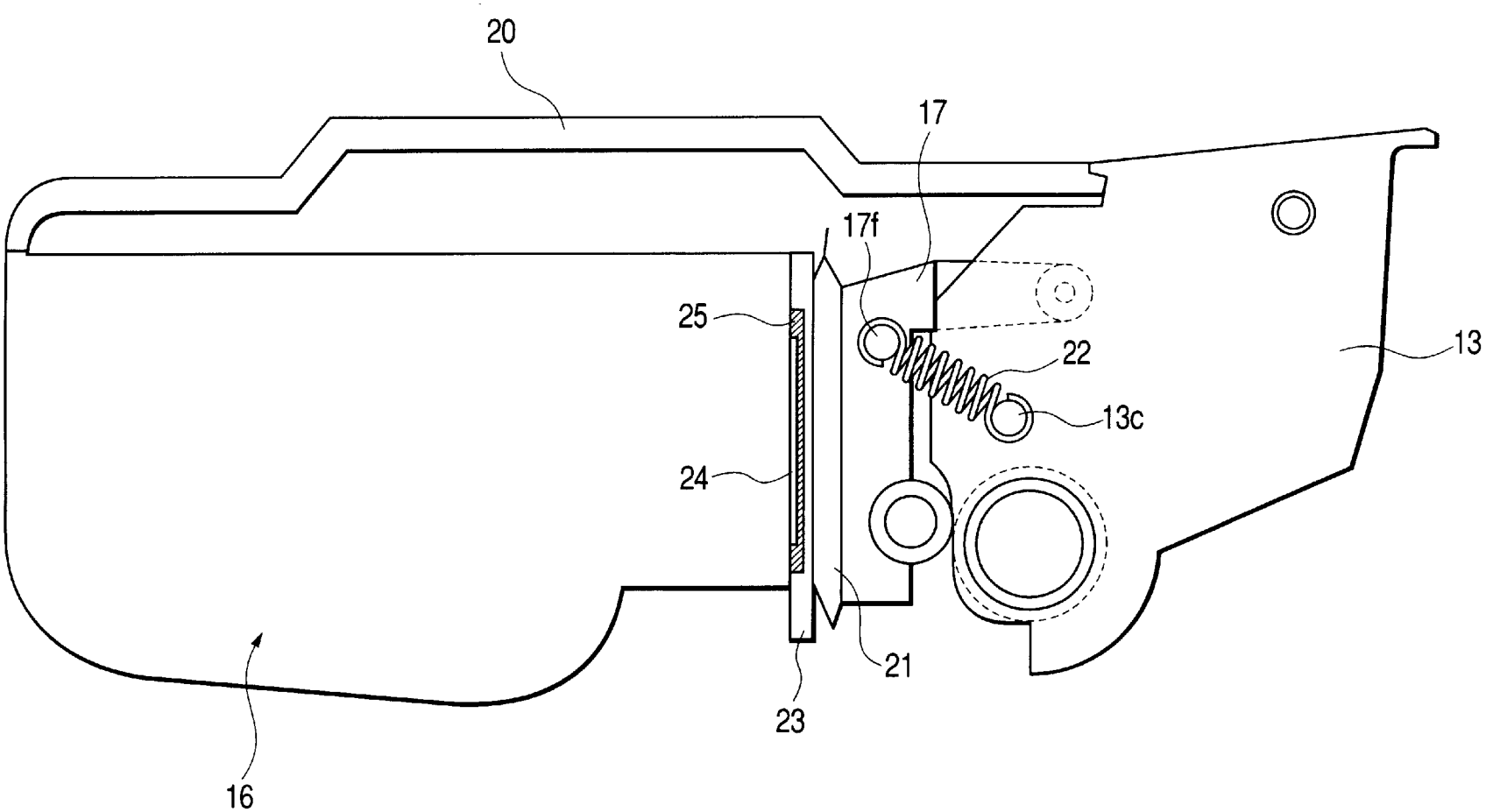
FIG. 6 is a side view of the process cartridge in the embodiment of the present invention.
Figure 7:
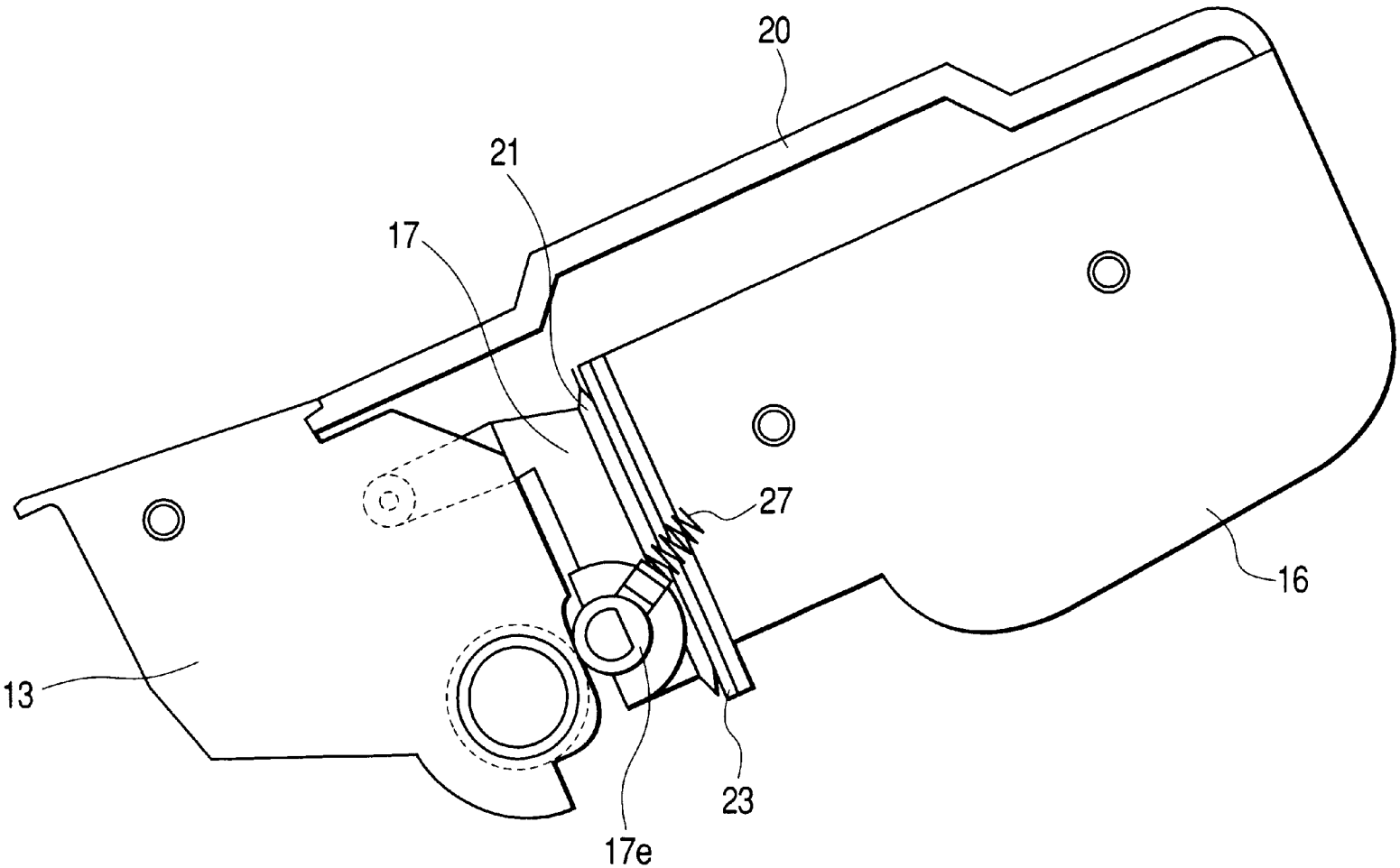
FIG. 7 is a side view of the process cartridge in the embodiment of the present invention.
Figure 8:
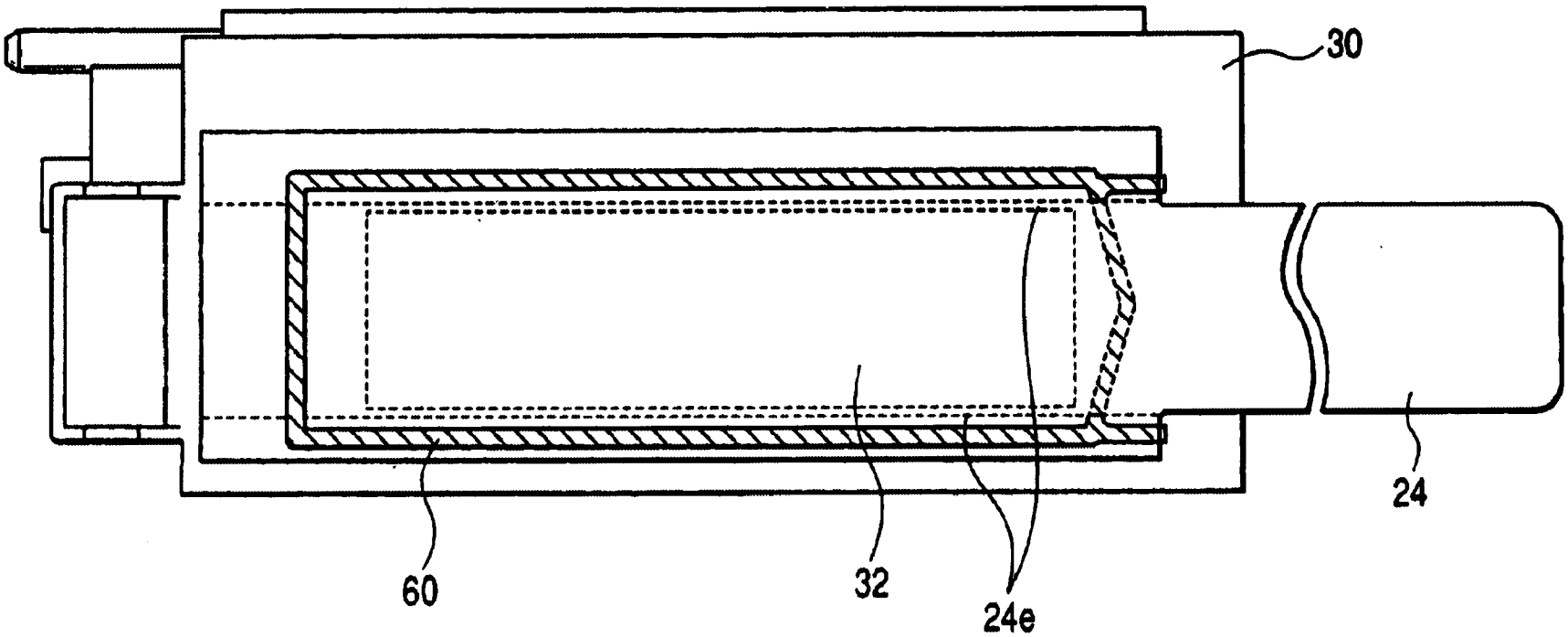
FIG. 8 is a front view of the toner discharge opening portion of a toner container in the embodiment of the present invention.

Also, as shown in FIG. 2, the developing frame 17 of the developing device D supports developing members, such as the developing roller 18 and the developing blade 26 and is swingably supported in the hanging hole 13*d* of the cleaning frame 13 by a pin so as to be rotatable about the hanging hole 13*d*. As shown in FIG. 6 in which the side cover 20 is removed, a tension coil spring 22 is extended between a spring hook 13*c* projectedly provided on the cleaning frame 13 and a spring hook 17*f* projectedly provided on the developing frame 17.

Also, a compression coil spring 27 (FIG. 7) is disposed in the interior of the side cover 19 so as to press a developing roller bearing 17*e*. The developing roller bearing 17*e* is movably fitted in a slot 19*e* in the side cover 19. The slot 19*e* extends in a radial direction of the photosensitive drum 11. By the spring forces of the compression coil spring 27 and the tension coil spring 22, abutment runners 18*b* having a radius as large as a developing gap (about 300 $\mu$m) and provided on the opposite end portions of the developing roller 18 concentrically therewith are brought into pressure contact with the outside of the image area of the photosensitive drum 11.

The design is made such that a gap is formed between the developing frame 17 and the toner container 30. Further, the toner container 30 is designed such that the lower side of the surface thereof opposed to the developing frame 17 is along a substantially horizontal line.

In the present embodiment, the gap between the developing device D and the toner container 30 is designed to be sealed, and as a seal member, a sheet member is stuck and formed into a bellows shape to thereby seal the gap, and the seal member is attached through a plate member. In this case, the sheet member has a thickness of 1 mm or less, but may have a thickness of 1 mm or greater by selecting a material which will not spoil the flexibility of the aforementioned bellows shape.

Figure 4:
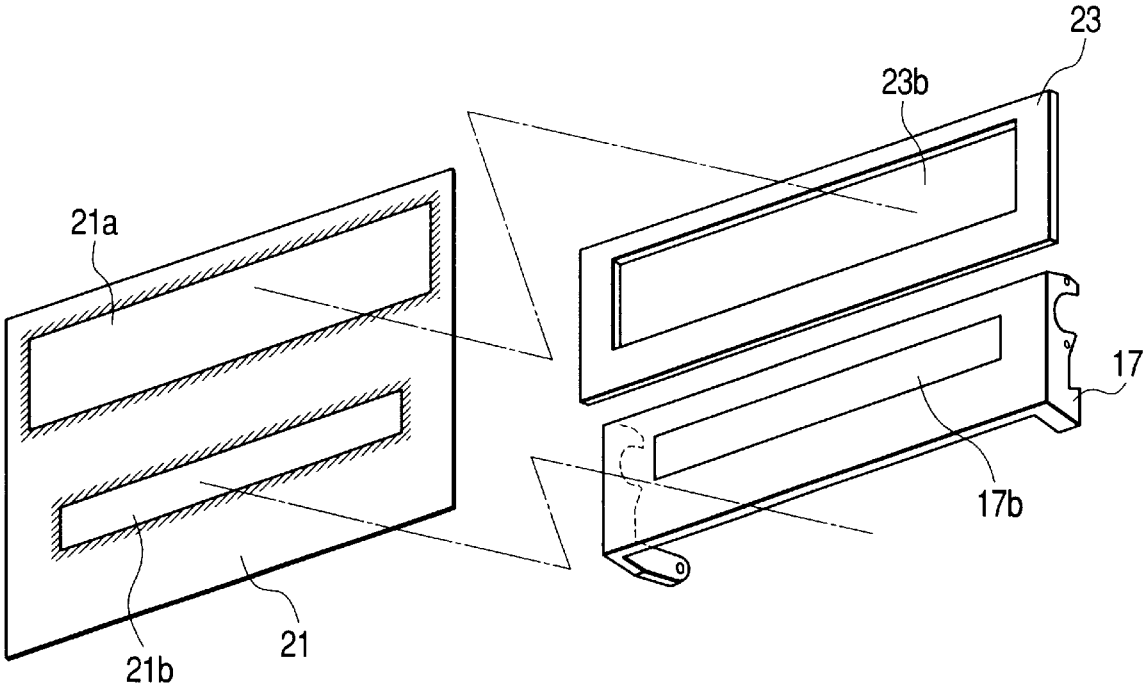
FIG. 4 is a perspective view of a seal member in the embodiment of the present invention.
Figure 5:
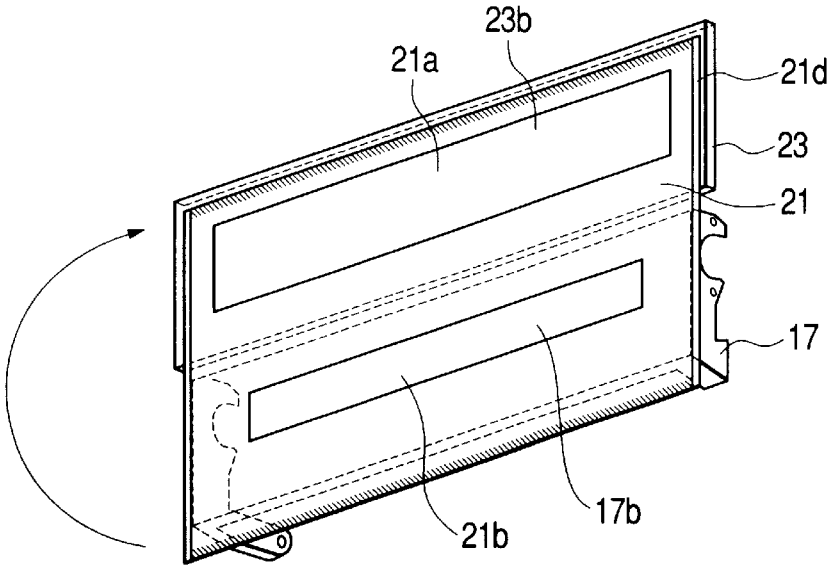
FIG. 5 is a perspective view of the seal member in the embodiment of the present invention.

FIGS. 4 and 5 schematically show a method of forming a bag-shaped seal member by the sheet member.

As shown in FIG. 4, the sheet member 21 has opening portions 21*a* and 21*b* substantially equal to or greater in area than the opening portion 23*b* of a plate-shaped member 23 and the opening portion 17*b* of the developing frame 17. The sheet member 21 is joined to the plate-shaped member 23 and the developing frame 17 in a closed shape (hatched portions) in the vicinity of the opening portions 23*b* and 17*b*.

In the case of the present embodiment, the joint of the developing frame 17 and the plate-shaped member 23 with the sheet member 21 is effected by heat welding such as by the heat sealing method or the impulse sealing method, but use may also be made of ultrasonic welding, an adhesive agent, an adhesive tape or the like.

Next, as shown in FIG. 5, the sheet member 21 is stuck on the developing frame 17 and the plate-shaped member 23, and thereafter is folded in the direction indicated by the arrow so that the both opening portions thereof may face each other to thereby form a bellows (a bag shape), and the end portions 21*d* (hatched portions) of the surfaces thereof turned back and facing each other are joined together and sealed. As sealing means in this case, use can also be made of heat welding such as the heat sealing method or the impulse sealing method, or ultrasonic welding, an adhesive agent or an adhesive tape.

Next, the plate-shaped member 23 is attached to the toner container 30, but at this time, a portion of the attached portion is not welded or adhesively secured so as to permit a toner seal member 24 to pass therethrough.

In the case of the present embodiment, the design is made such that a portion 23*a* shown in FIG. 3 is welded and an area in which a toner sealing member 25 holds down the toner seal member 24 is not welded or adhesively secured.

By doing so, even if the spacing between the opposed surfaces of the toner container 30 and the developing frame 17 fluctuates, the sealing member 21 completed by the use of the sheet member 21 (the same reference numeral 21 being used for the sheet member and the sealing member in its completed state) keeps the shape of a bag-shaped bellows and therefore, the resistance when displacement occurs can be made very small. Also, by the sealing member 21 being attached between the plate-shaped member 23 and the developing frame 17, the plate-shaped member 23 can be attached so as to cover the toner seal member 24, and it becomes possible to mount the toner sealing member 25 in the gap through which the toner seal member 24 passes, and the leakage of the toner can be prevented.

Further, when the plate-shaped member 23 and the developing frame 17 are to be sealed in the same plane, as compared with a case where the sheet member is directly stuck on the toner container 30, the shape of a welding receiving stand necessary for welding can be simplified.

Further, owing to the presence of the plate-shaped member 23, it becomes possible to make the developing frame 17 into a unit, and the attachment of the sealing member 21 to the toner containing unit 16 becomes easy.

(Mounting and Dismounting of the Process Cartridge to and from the Main Body of the Apparatus)

FIG. 1 shows a state in which the process cartridge 15 can effect image formation. To detach the process cartridge 15 from the state of FIG. 1, an operating lever (not shown) provided on the front face of the main body of the apparatus is pivotally moved, whereupon a pivotable arm 40 is pivotally moved in the direction indicated by the arrow A, and the left side of the process cartridge 15 as viewed in FIG. 1 is raised by the tip end of the arm 40. Thereupon, the left side of the process cartridge 15 is upwardly and pivotally moved about a fulcrum 15*b* on a guide rail 107, whereby a guide portion 15*a* present only on the inner part side of the process cartridge 15 is aligned with the guide rail 28 of the main body of the apparatus. When in this state, the process cartridge 15 is pulled in the direction of this side orthogonal to the plane of the drawing sheet of FIG. 1, the guide portion 15*a* shifts to the guide rail 28 and subsequently, the support of the process cartridge 15 by the arm 40 is released. When the process cartridge 15 is intactly drawn out, it can be drawn out of the main body of the apparatus.

To mount the process cartridge 15 to the main body of the apparatus, an operation converse to what has been described above can be performed, that is, with the guide portion 15*a* and the fulcrum 15*b* aligned with the guide rails 28 and 107, respectively, the process cartridge 15 is inserted into the inner part side orthogonal to the plane of the drawing sheet of FIG. 1. Thereupon, before the guide portion 15*a* comes out of engagement with the guide rail 28, the left upper portion of the process cartridge 15 is supported by the arm 40, and when the process cartridge 15 is further pushed in, the guide portion 15*a* comes out of engagement with the guide rail 28. Here, a lock (not shown) locking the arm 40 is released and by means of the aforementioned operating lever (not shown) provided on this side of the main body of the apparatus, the arm 40 is pivotally moved in the direction opposite to the direction indicated by the arrow A. The gravity of the process cartridge 15 is added to this pivotal movement.

When the process cartridge 15 comes close to a position capable of forming an image, a bearing pin 50 outwardly protruding from a hole 19*a* in the side cover 19 shown in FIG. 3 (this also holds true of the side cover 20 side) fits in the positioning recess (not shown) of the main body of the apparatus and is positioned. Thereby the position of the photosensitive drum 11 is accurately determined relative to the main body of the apparatus because the photosensitive drum 11 and the bearing pin 50 are coaxial with each other. The mounting and dismounting of such a process cartridge 15 with respect to the main body of the apparatus are good even if the toner container 30 contains a great amount of toner therein and is heavy. The process cartridge 15 has, besides the handle 10 on the upper portion thereof, a handle (not shown) on this side in the mounting and dismounting direction, and permits the carrying thereof or permits good operability at the beginning of the mounting and the end of the dismounting thereof from the main body of the apparatus.

(Description of the Toner Containing Unit)

The toner containing unit 16 will now be described with reference to FIGS. 8 to 11. The toner containing unit 16 is comprised of the toner container 30, the toner containing lid 31 and the agitating members 34, 35, 36. The toner container 30 is provided with an opening portion 32 for feeding the toner therethrough to the developing frame 17. The opening portion 32 is covered with the toner seal member 24. The toner seal member 24 is heat-welded to the toner container 30 around the opening portion 32 by a welding portion 60 (hatched portion) so as to cover the opening portion 32 (see FIG. 8).

The toner seal member 24 is folded back in the lengthwise direction of the opening portion 32 (the same direction as the lengthwise direction of the photosensitive drum 11) and is superposed on a portion covering the opening portion 32, and has its end portion drawn out of the cartridge frame (side cover 20) as shown in FIG. 3.

Figure 9:
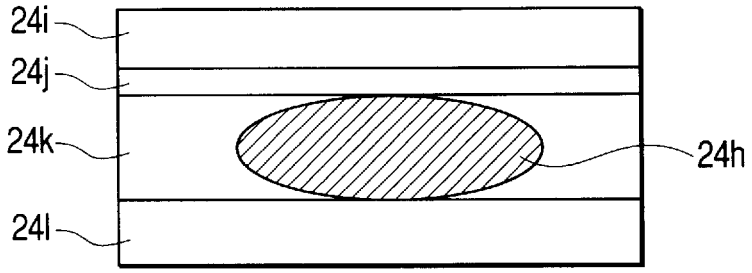
FIG. 9 is a cross-sectional view of a toner seal member in the embodiment of the present invention.
Figure 10:
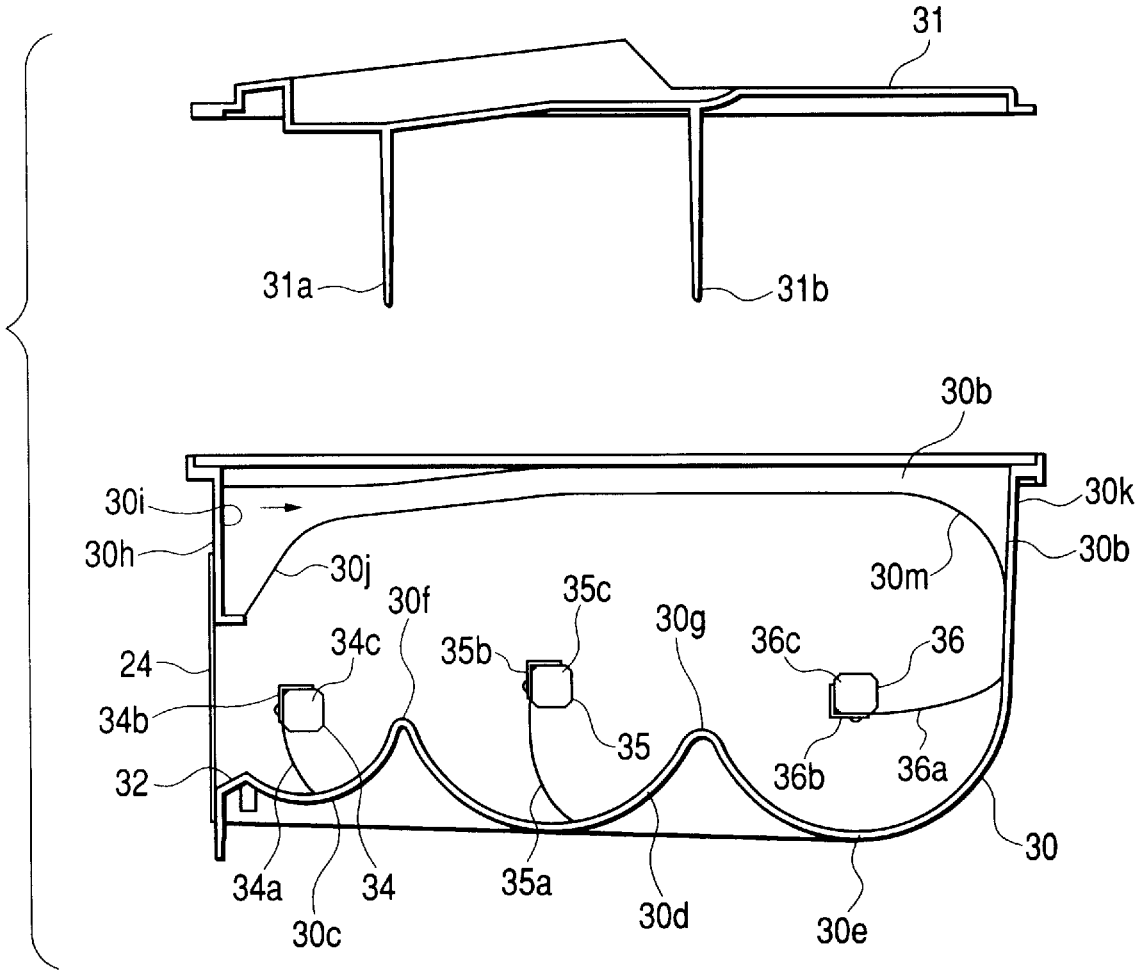
FIG. 10 is a vertical cross-sectional view of a toner containing unit in the embodiment of the present invention before it is welded.
Figure 11:
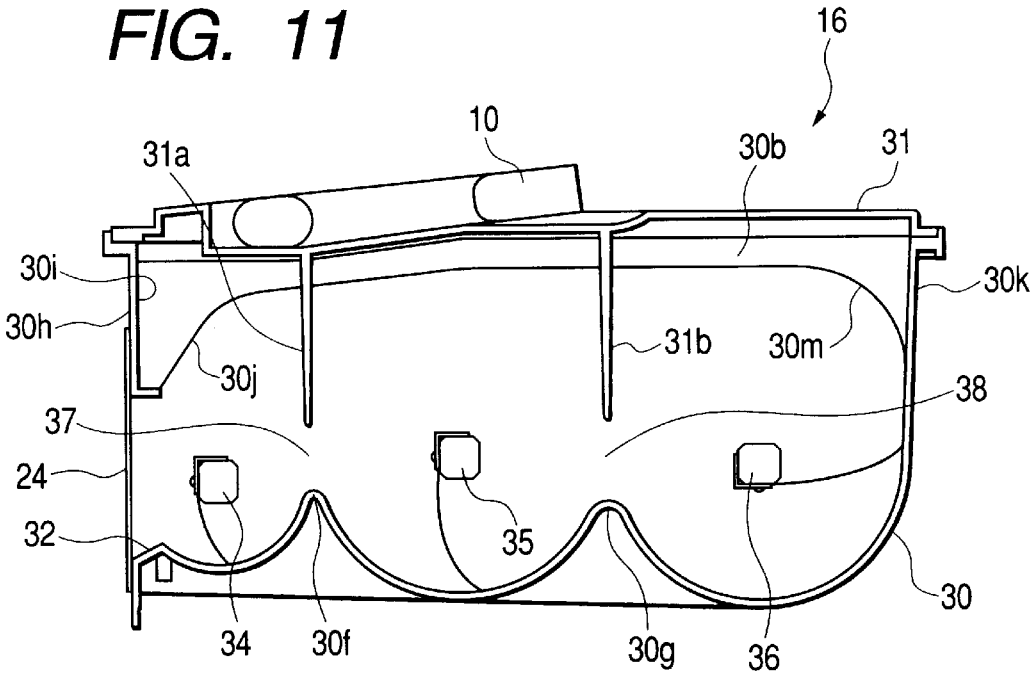
FIG. 11 is a vertical cross-sectional view of the toner containing unit in the embodiment of the present invention after it is welded.
Figure 12:
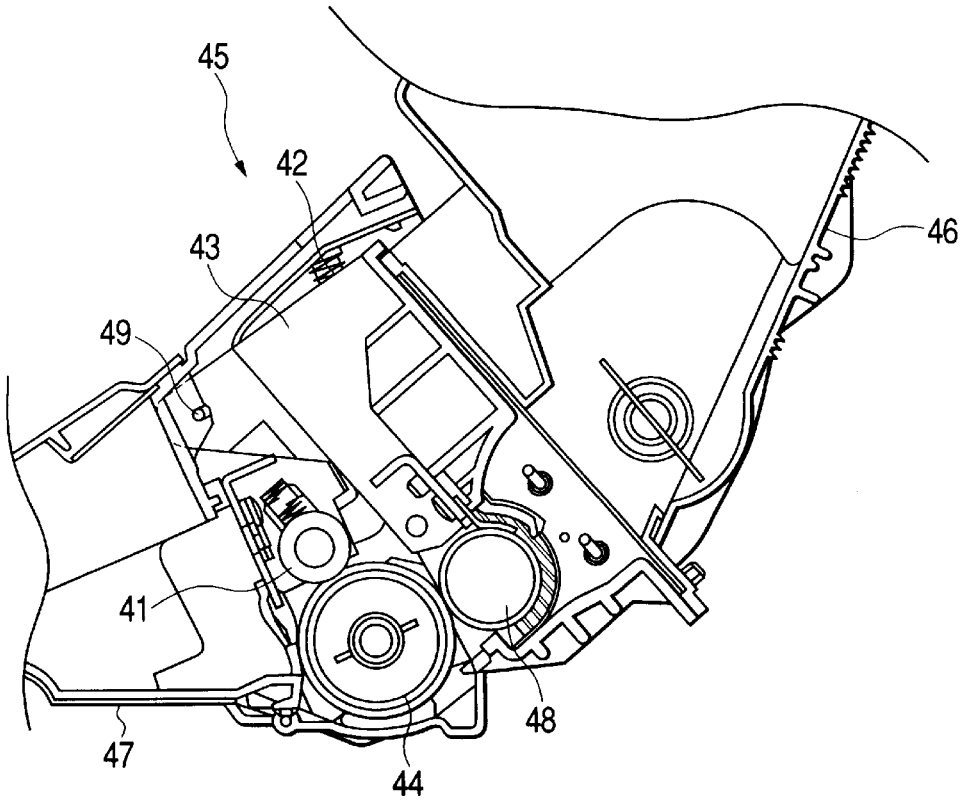
FIG. 12 PRIOR ART
FIG. 12 is a main cross-sectional schematic view of a process cartridge according to the prior art.

The toner seal member 24 used in the present embodiment is of a layer construction comprising, in succession from the surface layer, polyester of 12 μm (strength maintaining layer, 24*i* in FIG. 9), aluminum foil of 7 μm (laser intercepting layer, 24*j* in FIG. 9), polyester of 50 μm (tear guide layer, 24*k* in FIG. 9), and a sealant layer 50 μm (container adhesive layer, 24*l* in FIG. 9).

A tear portion 24*e* (see FIG. 8) for unsealing is subjected to the laser cutting process by which a carbon dioxide laser is applied from a sealant layer side and a part of a polyester layer which is a tear guide layer 24*k* and a sealant layer (24*l*) is melted, whereby a cavity portion 24*h* is formed (FIG. 9 is a cross-sectional view of the seal member and shows the cavity portion 24*h* by laser working). An aluminum foil layer 24*j* intercepts the laser and therefore, the outermost polyester layer (24*i*) is not injured, but can maintain a sufficient sealing property. During unsealing, stress concentrates in the cavity portion 24*h* formed by the laser working process and therefore, the toner seal member can be positively torn and unsealed along the tear portion 24*e*.

Also, in the toner container 30, there are provided the agitating members 34, 35 and 36 for feeding the toner from the opening portion 32 to the developing frame 17 and agitating the toner. The agitating members 34, 35 and 36 comprise flexible sheet members 34*a*, 35*a* and 36*a* fixed to agitating bars 34*c*, 35*c* and 36*c*, respectively, by sheet holding members 34*b*, 35*b* and 36*b*. In the present embodiment, as the sheet member 34*a*, use is made of a sheet member of PPS material having a thickness of about 50 μm, and as each of the sheet members 35*a* and 36*a*, use is made of a sheet member of PPS having a thickness of about 100 μm. Also, the agitating members 34, 35 and 36 are all rotated in the same direction (clockwise direction in FIG. 2), and the agitating member 34 nearest to the developing frame 17 is rotated at about 20 rpm and the remaining agitating members 35 and 36 are rotated at about 5 rpm.

The bottom surface of the toner container 30 assumes the cross-sections of semicircular portions 30*c*, 30*d* and 30*e*. This is because by the bottom surface of the toner container 30 being made semicircular and the radius of rotation of the agitating members 34, 35 and 36 being made larger than the radius of the bottom surface, it becomes possible for the sheet members to agitate the toner while rubbing against the bottom surface and even when the consumption of the toner has progressed and the amount of the toner has become small, the toner on the bottom surface can be scraped off and fed to the developing frame 17 and it becomes possible to decrease the amount of remaining toner. In the present embodiment, the inroad amount of the sheet members 34*a*, 35*a* and 36*a* into the semicircular portions 30*c*, 30*d* and 30*e*, respectively, is 2–4 mm.

The toner container 30 has the other end surface 30*k* substantially in parallel to the back side 30*i* of a surface 30*h* to which the plate-shaped member 23 is attached.

In the toner container 30, there is provided a bridge-shaped rib 30*b* extending from the back side 30*i* of the surface 30*h* of the toner discharging opening portion 32 to which the plate-shaped member 23 is attached to the other end surface 30*k* of the toner container 30. The bridge-shaped rib 30*b* has its lower edge rising upwardly by an inclined surface 30*j* from the upper back side edge of the opening portion 32 to a position at which it is not a hindrance when the agitating member 34 is incorporated into the toner container 30, and thereafter is connected to the other end surface 30*k* of the toner container 30 so as not to interfere with the toner agitating members 34, 35 and 36, and continues to the other end surface 30*k* by an arc 30*m*. The bridge-shaped rib 30*b* is provided in the substantially central portion of the toner container 30 in the lengthwise direction thereof (a direction orthogonal to the plane of the drawing sheet of FIG. 10). The cross-section of the bridge-shaped rib 30*b* which is formed as a bridge-shaped portion is of a plate shape whose plate surface is vertical, but the cross-sectional shape thereof may be another shape such as a T-shape, a I-shape, an H-shape, a circle or a U-shape.

Also, on that side of the toner containing lid 31 which is adjacent to the toner container, intercepting ribs 31*a* and 31*b* are provided toward the lengthwise direction at locations substantially aligned with the convex portions 30*f* and 30*g* of the bottom surface of the toner container 30. The intercepting ribs 31*a* and 31*b* are cut away at the central portions 31*c* thereof so as not to interfere with the bridge-shaped rib 30*b* in the toner container 30 (see FIG. 3).

After the agitating members 34, 35 and 36 have been incorporated into the toner container 30, the toner containing lid 31 and the toner container 30 are welded together to thereby form the toner containing unit 16. At this time, the gaps 37 and 38 between the intercepting ribs 31*a*, 31*b* and the convex portions 30*f*, 30*g* are intervals necessary to feed out the toner, and in the present embodiment, they are gaps of about 10 mm to about 16 mm.

The toner containing unit is thus constructed, and is filled with the toner through the toner filling port 30*l* of the toner container 30 shown in FIG. 3, and is sealed by a toner cap 39, whereby the toner containing unit 16 is provided.

According to the above-described embodiment, even in a large-capacity process cartridge wherein a bridge-shaped portion for achieving the improved strength of the toner opening portion is provided in the toner container to thereby stick together and construct the sheet members of the sealing member for making it possible to absorb the relative position of the developing frame and the developer container, and the developing frame and the developer container are not welded together, it is possible to keep the strength of the toner opening portion without providing any discrete member, and prevent the exfoliation and breakage of the toner seal member.

As described above, according to the present embodiment, the strength of the toner opening portion can be improved.

While the invention has been described with reference to the structure disclosed herein, it is not confined to the details set forth and this application is intended to cover such modifications or changes as may come within the purposes of the improvements or the scope of the following claims.

What is claimed is:

1. A developer container containing a developer comprising:

an opening portion sealed by a toner seal member and adapted to be unsealed during use to supply developing means with the developer and positioned on an opening portion side of said developer container; and a connecting portion extending from a back side of a surface of the opening portion side of said developer container and connected to an end surface of said developer container that is opposed to and substantially parallel to the surface of the opening portion side of said developer container.

2. A developer container according to claim 1, wherein said connecting portion is provided in substantially a center of said opening portion.

3. A process cartridge detachably mountable to an image forming apparatus, said process cartridge comprising:

an electrophotographic photosensitive member;

developing means configured and positioned to develop an electrostatic latent image formed on said electrophotographic photosensitive member by a developer;

a developing frame supporting said developing means and having an opening portion for receiving the developer therein;

a developer container containing the developer and moveable relative to said developing frame, said developer container comprising:

an opening portion configured and positioned to supply said developing means with the developer and positioned on an opening portion side of said developer container; and, a connecting portion extending from a back side of a surface of the opening portion side of said developer container and connected to an end surface of said developer container that is opposed to and substantially parallel to the surface of the opening portion side of said developer container; and a toner seal member configured and positioned to unsealably seal said opening portion of said developer container.

4. A process cartridge according to claim 3, wherein said connecting portion is provided in substantially a center of said opening portion of said developer container.

5. An electrophotographic image forming apparatus to which a process cartridge is detachably mountable for forming an image on a recording medium, said electrophotographic image forming apparatus comprising:

(a) mounting means for detachably mounting the process cartridge, the process cartridge comprising: an electrophotographic photosensitive member; developing means configured and positioned to develop an electrostatic latent image formed on the electrophotographic photosensitive member by a developer; a developing frame supporting the developing means and having an opening portion for receiving the developer therein; a developer container containing the developer and moveable relative to the developing frame, the developer container comprising an opening portion for supplying the developing means with the developer and positioned on an opening portion side of the developer container, and a connecting portion extending from a back side of a surface of the opening portion side of the developer container and connected to an end surface of the developer container that is opposed to and substantially parallel to the surface of the opening portion side of the developer container; and a toner seal member for unsealably sealing the opening portion of the developer container; and (b) transporting means for transporting the recording medium.

6. An electrophotographic image forming apparatus according to claim 5, wherein the connecting portion of the developer container of the process cartridge is provided in substantially a center of the opening portion.

7. A developer container comprising:

a container body configured to contain a developer, said container body being formed by a bottom wall, two side walls, a first end wall, and a second end wall being substantially parallel to said first end wall, said first end wall being provided with an opening configured and positioned to feed the developer; and a member connecting said first end wall and said second end wall.

8. A developer container according to claim 7, further comprising: an attachment surface onto which a toner seal member is to be attached, said attachment surface surrounding said opening and provided on an outer side of said first end wall.

9. A developer container according to claim 7 or 8, wherein said member is a rib connecting an inner side of said first end wall and an inner side of said second end wall, and wherein said rib is provided in substantially a center of said container body.

10. A developer container according to claim 9, wherein said rib is provided above said opening and has a cross-section having the shape of the letter T, the letter I, the letter H, the letter U, or a circle.

11. A process cartridge detachably mountable to a main body of an image forming apparatus, said process cartridge comprising:

an electrophotographic photosensitive member;

a developing frame supporting a developing roller configured and positioned to develop a latent image formed on said electrophotographic photosensitive member; and a developer container, said developer container including:

a container body configured to contain a developer, said container body being formed by a bottom wall, two side walls, a first end wall, and a second end wall substantially parallel to said first end wall, said first end wall being provided with an opening for feeding the developer to said developing frame; and a member connecting said first end wall and said second end wall.

12. A process cartridge according to claim 11, wherein said developer container includes an attachment surface onto which a toner seal member is attached, said attachment surface surrounding said opening and provided on an outer side of said first end wall, and wherein said process cartridge further comprises a toner seal member attached to said attachment surface to close said opening, said toner seal member being removable from said process cartridge to open said opening.

13. A process cartridge according to claim 11 or 12, wherein said member is a rib connecting an inner side of said first end wall and an inner side of said second end wall, and wherein said rib is provided in substantially a center of said container body.

14. A process cartridge according to claim 13, wherein said rib is provided above said opening and has a cross-section having the shape of the letter T, the letter I, the letter H, the letter U, or a circle.

15. An electrophotographic image forming apparatus to which a process cartridge is detachably mountable and which is configured and positioned to form an image on a recording medium, said electrophotographic image forming apparatus comprising:

(a) mounting means for detachably mounting the process cartridge, the process cartridge comprising:

an electrophotographic photosensitive member;

a developing frame supporting a developing roller configured and positioned to develop a latent image formed on the electrophotographic photosensitive member; and a developer container, the developer container including:

a container body configured to contain a developer, the container body being formed by a bottom wall, two side walls, a first end wall, and a second end wall substantially parallel to the first end wall, the first end wall being provided with an opening configured and positioned to feed the developer to the developing frame; and a member connecting the first end wall and the second end wall: and (b) transporting means for transporting the recording medium.

16. An electrophotographic image forming apparatus according to claim 15, wherein the developer container includes an attachment surface onto which a toner seal member is attached, said attachment surface surrounding the opening and provided on an outer side of the first end wall, and wherein the process cartridge further comprises a toner seal member attached to the attachment surface to close the opening, the toner seal member being removable from the process cartridge for opening the opening.

17. An electrophotographic image forming apparatus according to claim 15 or 16, wherein the member is a rib connecting an inner side of the first end wall and an inner side of the second end wall, and wherein the rib is provided in substantially a center of the container body.

18. An electrophotographic image forming apparatus according to claim 17, wherein the rib is provided above the opening and has a cross-section having the shape of the letter T, the letter I, the letter H the letter U, or a circle.

* * * * *

UNITED STATES PATENT AND TRADEMARK OFFICE

CERTIFICATE OF CORRECTION

PATENT NO. : 6,671,474 B2
DATED : December 30, 2003
INVENTOR(S) : Kazuo Chadani

It is certified that error appears in the above-identified patent and that said Letters Patent is hereby corrected as shown below:

Column 8,
Line 61, "a" (2nd occurrence) should read -- an --.

Column 9,
Line 67, "and," should read -- and --.

Column 12,
Line 38, "letter H" should read -- letter H, --.

Signed and Sealed this

Sixth Day of July, 2004

JON W. DUDAS
*Acting Director of the United States Patent and Trademark Office*